United States Patent [19]

Kemper

[11] 4,182,499

[45] Jan. 8, 1980

[54] MACERATOR PUMP

[75] Inventor: James M. Kemper, Sherman Oaks, Calif.

[73] Assignee: Monogram Industries, Inc., Los Angeles, Calif.

[21] Appl. No.: 660,646

[22] Filed: Feb. 23, 1976

[51] Int. Cl.[2] ..... B02C 18/06; B02C 18/40

[52] U.S. Cl. ..... 241/46.02; 241/46.17; 241/89.4; 241/166

[58] Field of Search ..... 241/46 R, 46 B, 46.02, 241/46.04, 46.11, 46.17, 185 A, 89.4

[56] References Cited

U.S. PATENT DOCUMENTS

| | | | |
|---|---|---|---|
| 431,230 | 7/1890 | Leopold | 241/82.5 |
| 1,504,067 | 8/1924 | Matthies | 241/82.5 |
| 3,109,471 | 11/1963 | Highley | 241/89.4 |
| 3,323,650 | 6/1967 | Kilbane, Jr. | 241/46.17 |
| 3,589,623 | 6/1971 | Belden | 241/46.02 |
| 3,934,827 | 1/1976 | Seydelmann | 241/82.3 |

*Primary Examiner*—Robert L. Spicer

*Attorney, Agent, or Firm*—Poms, Smith, Lande & Rose

[57] ABSTRACT

A macerator pump is disclosed having a collector housing for receiving waste material therein, a positive displacement pump coupled to the housing with an apertured plate separating the same, and a motor coupled to the pump for actuating the same and terminating in the housing with a cutting blade rotatable over the plate. The blade may be continually biased against the plate and the plate may include means for cleaning the blade by kicking any waste material not cut by the blade to a size sufficient to pass through the apertures back into the interior of the collector housing. The blade may also have reversible cutting edges.

6 Claims, 5 Drawing Figures

MACERATOR PUMP

BACKGROUND OF THE INVENTION

1. Field of the Invention

The invention relates to macerator pumps and more particularly, to a macerator pump which is adapted to macerate materials, such as sewage or human waste, into particles of a predetermined size and pump the macerated materials to a desired location.

2. Description of the Prior Art

There are various systems for disposing of waste, such as human waste, either on site or to a remote location. Although some on-site disposal type systems provide means for on-site disposal of a mixture of flushing fluid and human waste resulting from use of toilets, urinals, or the like, it may be inconvenient or contrary to law to dump such mixture at certain times or at any time, such as in harbors or at stations or the like unless such waste has been ground to a predetermined size and treated in a manner reducing the bacteria count thereof.

Self-contained recirculating toilet systems have been used on vehicles, such as buses, railroad trains, boats, aircraft and the like. Such systems generally comprise a plurality of substantially independent recirculating toilet systems, each with its own filter and pump assembly and storage tank.

In both systems, if such waste is to be disposed in situ, such as along a railroad track, from an aircraft, while travelling on a highway, into a body of water, etc., the waste must be treated prior to dumping. Certain regulations may also require that the waste must be reduced to a particular size prior to dumping. Such size may be determinable by the ability of the waste to pass through a certain sized sieve. Generally the waste must be chemically treated prior to disposal. There is a need for a macerator that can reduce materials, such as sewage or human waste to a particular size so that the waste can be subsequently disposed of in situ, if desired, without causing pollution or the like.

In my copending application, Ser. No. 660,645, filed Feb. 23, 1976, now also U.S. Pat. No. 4,032,995, issued on July 5, 1977, assigned to Monogram Industries, Inc., I disclosed a system for macerating and treating human waste. In that system, I disclosed the fact that any suitable macerator pump may be used. However, the macerator pump disclosed in this application is particularly suited for use in the system disclosed in my copending application. However, the macerator pump of this application is not limited to a human waste treatment system and may be useful in the macerating of any desired materials, such as sewage or the like.

SUMMARY OF THE INVENTION

It is an object of this invention to provide a macerator pump which is both self adjusting and self cleaning.

It is a further object of this invention to provide a macerator pump having its cutting blade located in a waste collection housing free of impediments therein so that there is nothing rotating ahead of the macerator cutting blade to catch unground materials and jam the mechanism.

It is still another object of this invention to provide a macerator pump having a vacuum pump downstream of the macerator.

It is a further object of this invention to provide a macerator pump wherein the macerator has a reversible blade so that, if the cutting edges on one side of the blade became damaged, the blade may be reversed and the cutting edges on the other side used.

These and other objects are preferably accomplished by providing a collector housing for receiving waste material therein, a positive displacement pump coupled to the housing with an apertured plate separating the same, and a motor coupled to the pump for actuating the same and terminating in the housing with a cutting blade rotatable over the plate. The blade may be continually biased against the plate and the plate may include means for cleaning the blade by kicking any waste material not cut by the blade to a size sufficient to pass through the apertures back into the interior of the collector housing. The blade may also have reversible cutting edges.

DESCRIPTION OF THE PREFERRED EMBODIMENT

Figure 1:
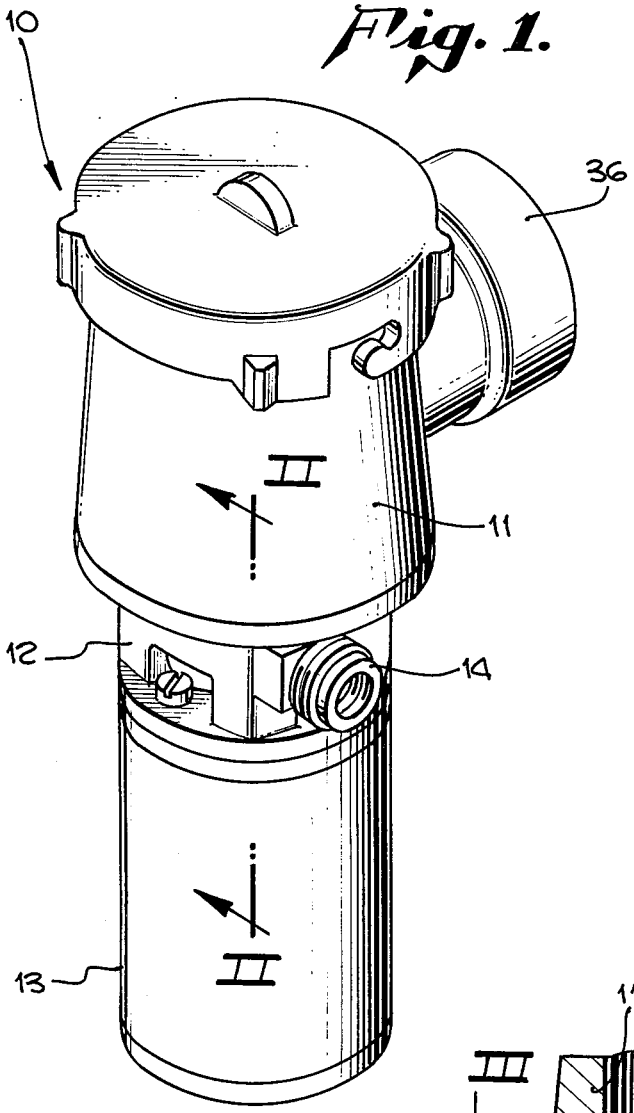
FIG. 1 is an isometric view of a macerator pump in accordance with the invention.

Referring now to FIG. 1 of the drawing, a macerator pump 10 in accordance with the invention is shown. Pump 10 includes a collector housing 11 bolted or otherwise secured to a pump 12, pump 12 being bolted or otherwise secured to a conventional motor 13. Motor 13 may be any suitable motor, such as a 12 volt D.C. motor which can be run off of the battery of the vehicle or vessel, if desired, in which pump 10 is installed.

As particularly contemplated in the present invention, pump 12 is a positive displacement vacuum pump having its inlet in fluid communication with the interior of collector housing 11, as will be described. The threaded outlet 14 of pump 12 is adapted to be coupled, if desired, to a conduit or the like (not shown) which may lead to a point opening exteriorly of the vessel or vehicle (also not shown) in which macerator pump 10 is installed (or to some other desired remote location).

Figure 5:
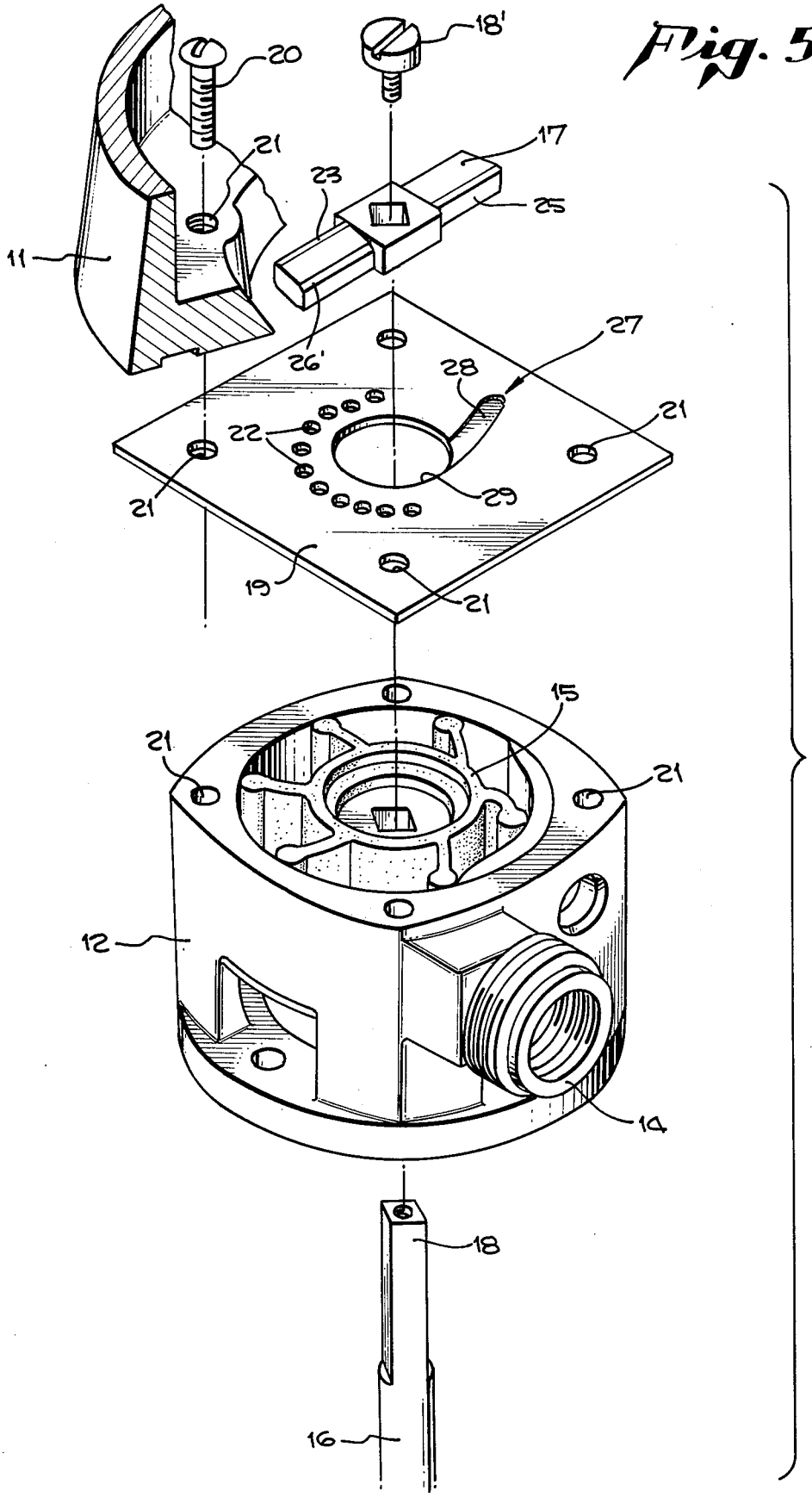
FIG. 5 is an exploded view of the macerator pump of FIG. 1.

The interior of pump 12 is shown more particularly in FIG. 5 and includes a flexible impeller 15, as is well known in the art, which is keyed to the shaft 16 (FIG. 3) of motor 13. It is to be understood that, as shaft 16 is rotated, impeller 15 sucks ground waste into the interior of pump 12 and pumps it out of outlet 14, as will be discussed.

Figure 3:
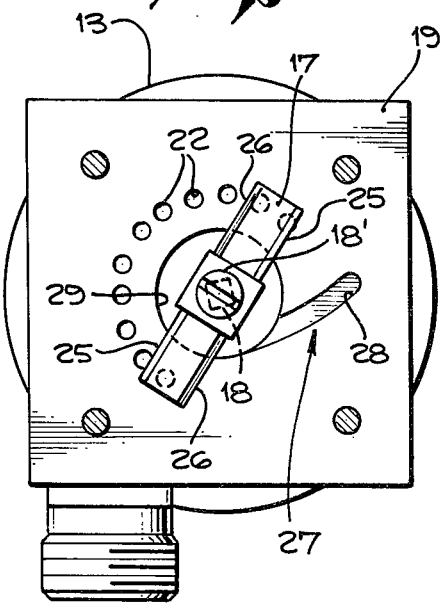
FIG. 3 is a view taken along lines III—III of the macerator pump of FIG. 2.

Referring also to FIG. 3, a cutting blade 17 is fixedly secured to the end of shaft 16 in any suitable manner, such as being keyed to the end of shaft 16 or shaft 16 terminating in an end 18 (FIG. 2) having blade 17 keyed thereon (see FIG. 5) and retained thereon by a screw 18'. A cutter plate 19 (FIGS. 3 and 5) separates pump 12 from collector housing 11. As shown in FIG. 5, screws 20 or the like are threaded through suitable apertures 21 in housing 11, plate 19 and pump 12 to secure the components together. Thus, no rotating components are present inside of housing 11 in front of blade 17.

Plate 19 includes a plurality of spaced apertures 22 of a predetermined size with cutting blade 17 being rotatable over apertures 22.

Figure 4:
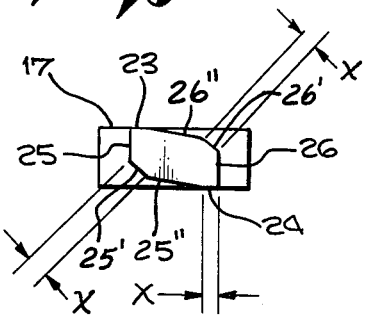
FIG. 4 is an end view of the blade alone of the macerator pump of FIGS. 1 through 3.

As particularly contemplated in the present invention, blade 17, as shown in FIG. 4, is reversible. That is, it presents a pair of cutting edges 23, 26' when positioned as shown in FIG. 5 and a pair of cutting edges 24, 25' which are adapted to be disposed against plate 19 in FIG. 5. If blade 17 is reversedly positioned on shaft 16 in FIG. 5, edges 24, 25' would be uppermost. Thus, if edges 23, 26' became damaged or otherwise lost their cutting ability, blade 17 may be reversed and edges 24, 25' used as the cutting edges, each edge 23, 24, 25' and 26' may be cut to a predetermined width x as shown in FIG. 4. Reference numerals 25, 26 refer to the respective sides of blade 17 as also shown in FIG. 5 (only side 25 being visible). As clearly shown in FIG. 4, each arm of blade 17 includes a first upper generally planar surface 23, a second downwardly extending generally planar surface 25 forming a substantially right angle with the first planar surface 23, and a third generally planar surface 25' extending downwardly and inwardly of its respective arm from the second planar surface 25. A fourth generally planar surface 25'' extends away from the third planar surface 25' and is at substantially an oblique angle thereto. A fifth planar surface 24 extends from the fourth planar surface 25'', the fifth planar surface 24 lying in a plane generally parallel to the plane of the first planar surface 23. A sixth planar surface 26 extends from the fifth planar surface 24 and forms substantially a right angle with respect thereto. The sixth planar surface 26 lies in a plane generally parallel to the plane of the second planar surface 25. A seventh planar surface 26' extends upwardly and inwardly of respective arm, the seventh planar surface 26' lying in a plane generally parallel to the plane of the third planar surface 25'. An eighth planar surface 26'' extends from the seventh planar surface 26' to the first planar surface 23, the eighth planar surface 26'' lying in a plane generally parallel to the plane of the fourth planar surface 25'', the intersection of all of the planar surfaces forming cutting edges.

Plate 19 also includes in the exemplary embodiment blade cleaning means 27 for kicking out any materials caught between blade 17 and plate 19 into the interior of housing 11 thus cleaning blade 17. In the exemplary embodiment, such blade cleaning means 27 includes a curved groove 28 extending from a centrally located aperture 29 in plate 19 (receiving shaft 16 therethrough) and curving radially outwardly in the direction of rotation of blade 17. Foreign materials not immediately cut by blade 17 on its first revolution may get under blade 17 (between blade 17 and plate 19) and raise it upwardly or away from plate 19 against its spring bias. Such materials would enter groove 28 and be kicked out. If groove 28 was not provided, when such materials were trapped between blade 17 and plate 19, the material, such as hose or the like, might merely spin around on the shaft end 18.

Figure 2:
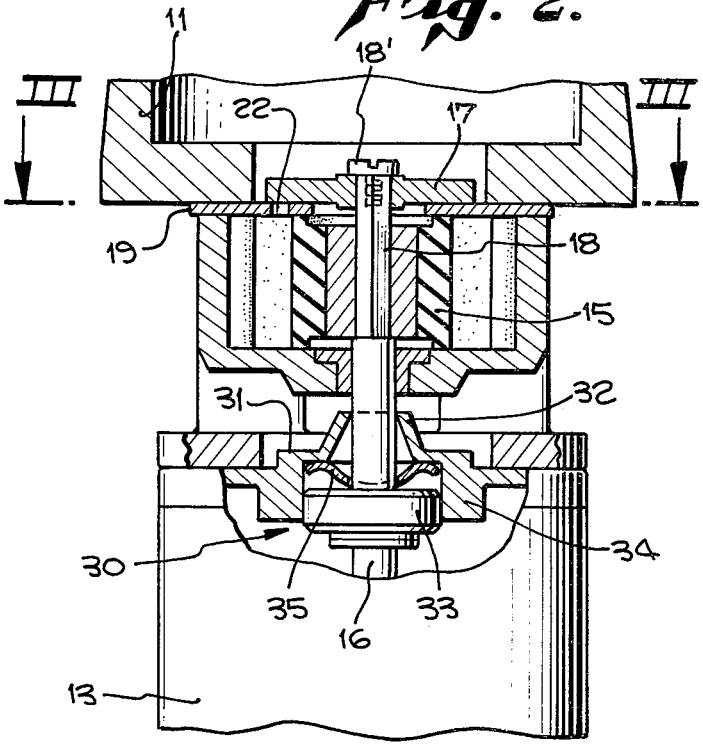
FIG. 2 is a view taken along lines II—II of FIG. 1.

Also, as particularly contemplated in the present invention, self-adjusting cutting blade means 30 are provided for retaining blade 17 in close proximity to plate 19 by pulling shaft 16 downwardly so that blade 17 is pulled and tensioned against plate 19. In the exemplary embodiment, such selfadjusting cutting blade means 30 includes the end bell 31 (FIG. 3), of the motor housing, separating pump 12 from motor 13, end bell 31 having an upwardly extending bell portion 32 integral therewith through which shaft 16 extends for preventing lateral movement of shaft 16. A bearing 33 is fixed to shaft 16 inside motor 13 and abuts against a spring means 35 which bears against the underside of end bell 31 as seen in FIG. 2. A downwardly extending section 34 may be provided in end bell 31 for accommodating bearing 33. Spring means 35, such as a spring washer, loosely encircles shaft 16 and is disposed between bearing 33 and end bell 31. Any suitable spring means may be used. Thus, spring means 35 pushes between bell portion 32 and bearing 33 which keeps shaft 16 pulled in a downward position and puts tension on blade 17. An inlet 36 is provided (FIG. 1) leading into the interior of housing 11.

In operation, waste or other material desired to be ground, is received into the interior of collector housing 11 through inlet 36 when pump 12 is actuated. Inlet 36 may be coupled to a suitable source of waste, such as a holding tank (not shown) in a toilet or the like. The waste in housing 11 is cut by the blade 17 and drawn through apertures 22, into pump 12 and out outlet 14 which may be coupled to a suitable macerated waste outlet leading to a macerated collection tank (not shown) or to a remote location where it may be dumped in situ, if desired. Spring means 35 keeps blade 17 pulled against plate 19 while under tension and any materials caught under blade 17, such as paper, fabric, or the like, are kicked out by groove 28 back into the interior of housing 11. If the cutting edges of blade 17 become damaged, blade 17 may be quickly and easily reversed.

In summary, a macerator pump is disclosed which includes an electric motor-driven, positive displacement vacuum pump attached to a self-adjusting, self-cleaning macerator. Known prior art macerators do not have any self-cleaning, adjusting feature. Without this feature, certain systems would never be successful, such as in a public toilet where people throw all unwanted articles into the toilet since prior art macerators would quickly become jammed.

Also, there is nothing rotating ahead of the macerator blades to catch unground cloth material and wind it into a ball. Macerators that have the pumping device downstream of the macerator must have a pump that will pump a vacuum when liquid being pumped is mostly air. Without the vacuum, fabric objects will not be drawn into the holes in the cutter plate so that the cutter blade may shear them off.

If the cutter blades of my macerator pump should become damaged, the blade may be turned over and the other side used. A vacuum pump is used downstream of the cutter plate and atmospheric pressure forces the waste such as the contents of a toilet, into the holes in the cutter plate so that the rotating blades shear parts off that are forced into the holes in the cutter plate.

I claim as my invention:

1. A macerator vacuum pump grinder adapted to receive a quantity of sewage material mixed with air to be ground, grind said material, and pump the ground material to a desired location comprising:

a collector housing having an inlet for receiving said material therein;

a positive displacement vacuum pump having an intake coupled to said collector housing and an outlet for pumping ground material out of said pump, said pump having a housing and a source of rotary motion including an impeller with a plurality of radially extending flexible fingers rotatable in said pump housing;

said source of rotary motion including a motor coupled to said pump having a rotatable motor shaft extending through said pump and coupled to said impeller for actuating said pump and terminating in said collector housing and having a cutting blade fixedly mounted on said motor shaft for rotation therewith;

a cutter plate interposed between said pump and said supply of material to be ground separating said collector housing from said pump intake, said plate having a plurality of spaced apertures therein of a predetermined size with said cutting blade being rotatable across said cutter plate and said apertures when said motor is actuated and abutting against said plate;

spring means operatively connected to said motor shaft adapted to bias said blade against the plate so that the blade continually rubs up against the plate whereby said blade and plate apertures are in motion relative to each other and all flow into the pump intake is through the apertures in said plate and said sewage material cannot pass through said pump without being macerated;

said cutting blade being reversible and including a cutting edge on both sides thereof; and said blade including a central portion fixed to said shaft, a pair of arms extending on both sides of said central portion and integral therewith, each of said arms having a first upper generally planar surface, a second downwardly extending generally planar surface forming a substantially right angle with said first planar surface, a third generally planar surface extending downwardly and inwardly of said respective arm from said second planar surface, a forth generally planar surface extending away from said third planar surface and at substantially an oblique angle thereto, a fifth planar surface extending from said fourth planar surface, said fifth planar surface lying in a plane generally parallel to the plane of said first planar surface, a sixth planar surface extending from said fifth planar surface and forming substantially a right angle with respect thereto, said sixth planar surface lying in a plane generally parallel to said third planar surface, and an eighth planar surface extending from said seventh planar surface to said first planar surface, said eighth planar surface lying in a plane generally parallel to the plane of said fourth planar surface, the intersection of all of said planar surfaces forming cutting edges.

2. The macerator pump grinder of claim 1 wherein said plate includes blade cutting means associated therewith for kicking back into the interior of said collector housing materials caught between said blade and said plate thereby cleaning said blade.

3. The macerator pump grinder of claim 2 wherein said blade cleaning means includes a groove in said plate.

4. The macerator pump grinder of claim 3 wherein said plate includes an opening therein through which said motor shaft extends and said groove extends from said opening curving radially outwardly therefrom in the direction of rotation of said blade.

5. The macerator pump grinder of claim 1 wherein the interior of said collector housing is free of rotatable components therein other than said blade.

6. The macerator pump grinder of claim 1 wherein said spring means includes a partition separating said pump from said motor, said partition having an aperture therethrough with said motor shaft extending through said partition, a bearing encircling said motor shaft and fixed thereto between said motor and said partition, and a spring washer encircling said motor shaft disposed between said bearing and said partition and abutting against said partition thereby biasing said blade against said partition.

* * * * *